US008789690B2

(12) United States Patent
Adler

(10) Patent No.: US 8,789,690 B2
(45) Date of Patent: Jul. 29, 2014

(54) PROTECTIVE COVERS FOR PHYLACTERIES

(76) Inventor: Ira N. Adler, Monsey, NY (US)

( * ) Notice: Subject to any disclaimer, the term of this patent is extended or adjusted under 35 U.S.C. 154(b) by 461 days.

(21) Appl. No.: 13/188,722

(22) Filed: Jul. 22, 2011

(65) Prior Publication Data

US 2012/0000799 A1 Jan. 5, 2012

Related U.S. Application Data

(63) Continuation-in-part of application No. 12/140,298, filed on Jun. 17, 2008, now abandoned.

(51) Int. Cl.
*B65D 85/02* (2006.01)
*A47G 33/00* (2006.01)

(52) U.S. Cl.
CPC ..... *A47G 33/00* (2013.01)
USPC ..... 206/8; 206/19

(58) Field of Classification Search
USPC ..... 206/8, 19
See application file for complete search history.

(56) References Cited

U.S. PATENT DOCUMENTS

D163,077 S * 4/1951 Weiszberg ..... D3/294
5,947,271 A * 9/1999 Follman ..... 206/19

* cited by examiner

*Primary Examiner* — Tri Mai
(74) *Attorney, Agent, or Firm* — Davidoff Hutcher & Citron LLP; Michael A. Adler

(57) ABSTRACT

Protective covers for Phylacteries including an upper shell member and a lower shell member at least partially separable from one another and which, when together, define a hollow interior contoured to fit the Phylactery. One or two lateral extension portions, depending on whether the protective cover is for a head Phylactery or an arm Phylactery, are situated partly on each of the upper and lower shell members outward from a respective plane including a side surface of the cube-shaped portion and have a width of at least about 1.2 centimeters. A supplemental platform or support surface may be arranged alongside a rear side of a cube-shaped portion of the upper shell member facing the slot of the protective cover to support for a knot of the strap of the head Phylactery when the head Phylactery is housed in the protective cover.

21 Claims, 9 Drawing Sheets

PRIOR ART

PRIOR ART

PROTECTIVE COVERS FOR PHYLACTERIES

CROSS REFERENCE TO RELATED APPLICATION

This application is a continuation-in-part of U.S. patent application Ser. No. 12/140,298 filed Jan. 7, 2008, incorporated by reference herein.

FIELD OF THE INVENTION

The present invention is directed to protective covers for Phylacteries that allows for the placement of straps attached to the Phylacteries box to be more easily stored in conformity with Jewish law and code.

BACKGROUND OF THE INVENTION

For Jewish men, there is a Biblical obligation to wear a set of Phylacteries (also called tefillin), generally during the morning prayer service. A set of Phylacteries comprises a head unit for placement on the head and an arm unit for placement on the arm. Each Phylactery comprises two major components: a leather box that contains specific portions of the Bible written on parchment and a leather strap (retsua) attached to the box.

While initially preparing the straps and allowing for proper use, the leather straps are tied to head and arm Phylactery boxes with a special knot that forms a letter from the Hebrew alphabet, a letter which is part of one of the Hebrew names of G-d. To this end, FIG. 1 shows a head Phylactery box 10 with a head strap 12 and a knot 14 resembling the Hebrew letter Daled, one of the letters of one of the Hebrew names of G-d. FIG. 2 shows the arm Phylactery box 20 with a strap 22 and a knot 24 resembling the Hebrew letter Yud, another one of the letters of one of the Hebrew names of G-d. FIG. 3 shows a second of a head Phylactery wherein the knot 14 resembles a double Daled that looks like a box. Thus, on the head Phylactery, the strap 12 is manipulated to form a letter resembling a Daled (FIG. 1) or a double Daled (FIG. 3) while on the arm Phylactery, the strap 22 is manipulated to form a letter resembling a Yud (FIG. 2).

Once the Phylacteries are attached to the head and arm in the manner prescribed by Jewish law, the knot 14 of the strap 12 resembling the letter Daled of the head Phylactery will sit under the external occipital protuberance and the knot 24 of the strap 22 resembling the letter Yud will sit on the bicep of the individual's weaker hand.

It is the opinion of a noted Jewish scholar, Rashi, that the knots in the straps resembling the two letters Yud and Daled, but not the remaining portions of the straps, are on a very high level of holiness, equal to the holiness of the letter of a Torah (Rashi Tractate Shabbos 62a, Tractate Menachos 35b). The holiness of these knots is thus on a level higher than the holiness of the remainder of the straps, and even of the holiness of the bottom part of the Phylactery boxes, known as the teturah.

As a result of their heightened holiness according to Rashi, it is his opinion that the knots 14, 24 should not be stored under the bottom part of the Phylactery boxes and definitely not under any storage devices or protective covers in which the Phylacteries are stored when not in use, even inadvertently. Further, no other portion of the straps should be placed on the knots.

The head and arm Phylacteries are stored differently, partly in view of the different knots in the straps thereof. The present state of the art when storing head Phylacteries is to place the box 10 into a first, upper part or shell member 64 of a protective cover 62 having a portion substantially contoured to the shape of the box 10, and then manipulate a second, lower part or shell member 66 of the protective cover 62 to enclose the box 10, but without enclosing the entire strap 12 (see FIGS. 4A-4D). Moreover, the strap 12 is aligned with slots 68 in each side of the protective cover 62. The upper shell member 64 is partially separable from the lower shell member 66, i.e., pivotable relative thereto as shown in FIGS. 4C and 4D, but when together, define a hollow interior contoured to fit the Phylactery box 10. To this end, the upper shell member 64 includes a generally cube-shaped portion 70 having a rear surface 72, a front surface 74, lateral side surfaces 76, 78 extending between the front and rear surfaces 72, 74 and a substantially planar, rectangular lower surface 80 around the cube-shaped portion (see FIGS. 4A-4D). Slots 68 are present on each lateral side of the protective cover 62 and defined partly by the upper shell member 64 and partly by the lower shell member 66. A pivot pin 82 is arranged at the rear of the protective cover 62 to enable the upper shell member 64 to pivot relative to the lower shell member 66. In use, the knot 14 is usually then placed against the bottom of the protective cover 62 (see FIGS. 4, 4E and 4F) and, while the knot 14 is maintained in the position against the bottom the protective cover 62, the strap 12 is wrapped around the protective cover 62 by placing the portion of the strap 12 that surrounds the head on top of the protective cover 62 and the wrapping the portions of the strap 12 that hang from the knot 14 around the side portions of the protective cover 62.

Unfortunately, since this wrapping method results in the knot 14 being situated below the entire Phylactery box 10 and also below the protective cover 62 (when viewed as shown in FIGS. 4, 4E and 4F), it is in violation of the position (at least Rashi) that the knot 14 should not be placed below the Phylactery box 10 nor under the protective cover 62.

Moreover, in conventional protective covers, there is an insufficient ledge formed by the protective cover to adequately support the entire knot 14. Specifically, the width of the rear side of a conventional protective cover for a head Phylactery is no more than 3 centimeters. However, the length of the knot 14 is usually 4 or more centimeters. In view of this difference, when wrapping the hanging portions of a strap 12 around a conventional protective cover of a head Phylactery, the knot 14 is often not securely seated on the protective cover.

Further, if the knot 14 were to be placed on the upper side of the teturah alongside a portion of the protective cover covering the box 10, i.e., on the lower surface 80 of the upper shell member 64, there is not sufficient space to wrap the hanging portions of the strap 12 around the side portions of the protective cover 62 without covering the knot 14 because the conventional protective cover 62 has, at most, and usually less than, about 1.0 centimeters of space on the side portions around which to wrap the hanging portions of the strap 12. The approximate centimeter of space of the side portions of the protective cover 62 is insufficient to enable the wrapping of the hanging portions of the strap 12, which have a width of about 0.9 centimeters to about 1.5 centimeters, without wrapping the strap 12 on or over the knot 14. Because wrapping the hanging portions of the strap 12 over the knot is in violation of the position of Rashi, it is problematic to use conventional protective covers for a head Phylactery while complying with Rashi's position to maintain the heightened holiness of the knot 14 by both avoiding placing the knot 14 under the protective cover 62 and avoiding wrapping the strap 12 over the knot 14 if the knot 14 were placed on the top of the protective cover 62.

The present state of the art when storing arm Phylacteries is to place the box 20 into a first part or shell member of a protective cover having a portion substantially contoured to the shape of the box 20, and then manipulate a second part or shell member of the protective cover to enclose the box 20, but without enclosing the entire strap 22. The knot 24 is usually then placed against one side of the protective cover (the right side of right-handed individuals and the left side for left-handed individuals) and the strap 22 is then wrapped around one or more other sides of the protective cover to insure that nothing is placed atop the knot 24. However, sometimes, the strap 22 is quite long and cannot be securely wrapped around the sides of the protective cover without covering a portion of the knot 24.

In view of the foregoing issues, it would be desirable to provide new protective covers for both head and arm Phylacteries which enable easy compliance with Rashi's opinion relating to limitations imposed on the wrapping of straps relative to knots thereof.

SUMMARY OF THE INVENTION

The present invention comprises protective covers for Phylacteries to enable the Phylacteries to be stored without violating scholarly teachings discussed above.

One embodiment of a protective cover for a Phylactery, including a slot through which a strap of the Phylactery passes when the Phylactery is housed in the protective cover, includes an upper shell member and a lower shell member at least partially separable from one another and which, when together, define a hollow interior contoured to fit the Phylactery. To this end, the upper shell member includes a generally cube-shaped portion to fit the box of the Phylactery.

The protective cover in accordance with the invention includes a supplemental platform or support surface arranged alongside a rear side of the cube-shaped portion which faces the slot of the protective cover. The supplemental support surface is formed to enable the knot of the strap of the head Phylactery to be seated comfortably and securely thereon when the head Phylactery is housed in the protective cover and to substantially preclude the possibility of wrapping hanging portions of the strap around the knot when supported on the supplemental support surface. To this end, the supplemental support surface should extend only alongside a rear surface of the cube-shaped portion and thus not entirely across a rear side of the protective cover. An indentation or step is thereby formed alongside each lateral side of the protective cover and the hanging portions of the strap of the head Phylactery are wrapped through these indentations and not over the supplemental support surface on which the knot is seated.

The supplemental support surface may be defined by a projection situated on the rear side of the lower shell member along only a portion thereof, e.g., only alongside a rear surface of the cube-shaped portion. Alternatively, the supplemental support surface may be defined by a thin ledge extending from the upper or lower shell member beyond a rear wall of the lower shell member. For example, the upper shell member may include a substantially planar lower surface around the cube-shaped portion and the ledge extends from this lower surface. In either case, the supplemental support surface should provide a flat surface extending about 4.0 centimeters from the cube-shaped portion.

BRIEF DESCRIPTION OF THE DRAWINGS

For a better understanding of the present invention, reference is made to the following description and accompanying drawings, while the scope of the invention is set forth in the appended claims.

DETAILED DESCRIPTION OF THE INVENTION

Figure 1:
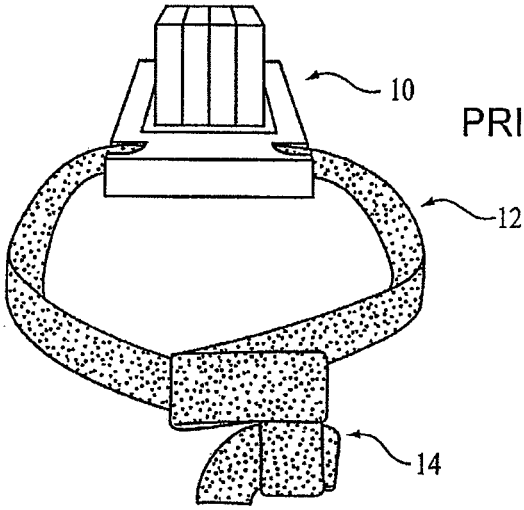
FIG. 1 PRIOR ART
FIG. 1 is an isometric view of a head Phylactery with a strap showing the knot that resembles the Hebrew letter Daled.
Figure 2:
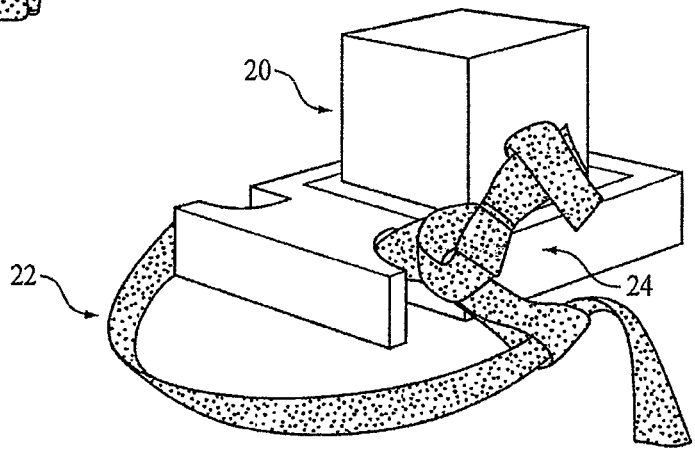
FIG. 2 PRIOR ART
FIG. 2 is an isometric view of an arm Phylactery with a strap showing the knot that resembles the Hebrew letter Yud.
Figure 3:
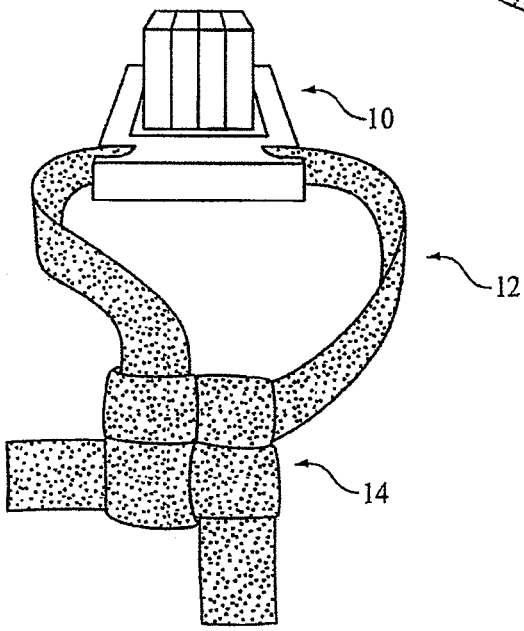
FIG. 3 is an isometric view of a head Phylactery with a strap showing the knot that resembles a double Hebrew letter Daled.
Figure 4:
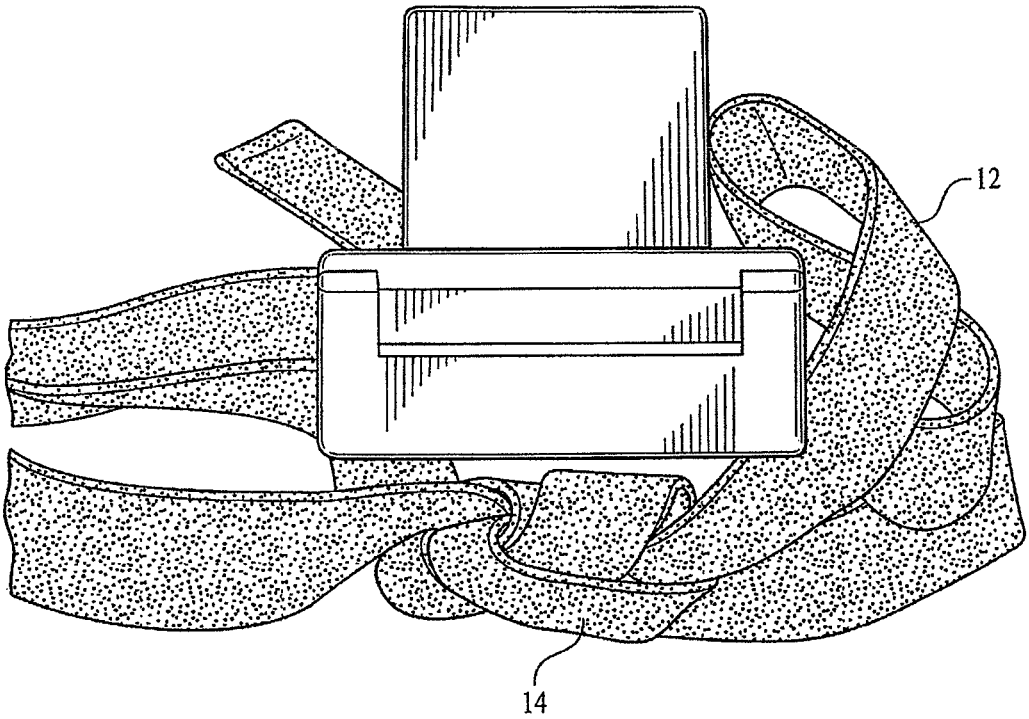
FIG. 4 is an isometric view of a conventional box for the head Phylactery shown in FIG. 1 or 3 with the strap in a position before being wrapped for storage in a conventional manner with the knot of the strap in a position below the box.
Figure 4A:
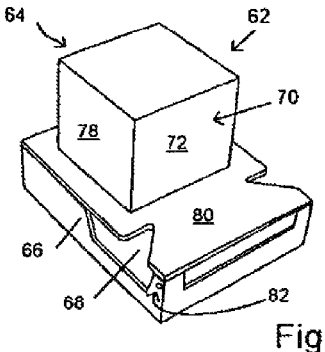
Fig. 4A PRIOR ART
FIGS. 4A and 4B are isometric, rear views of a protective cover for the head Phylactery when in a closed state.
Figure 4B:
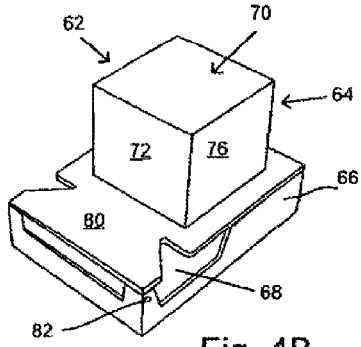
Fig. 4B PRIOR ART
Figure 4C:
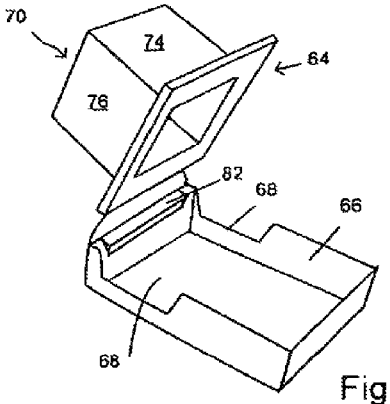
Fig. 4C PRIOR ART
FIGS. 4C and 4D are isometric, front views of the protective cover for the head Phylactery when in an open state.
Figure 4D:
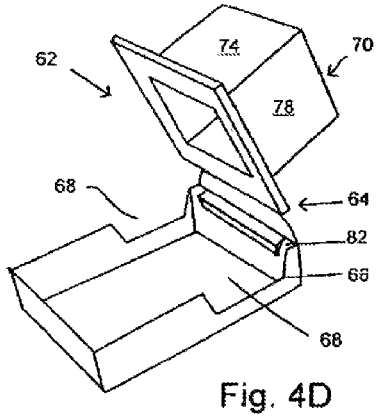
Fig. 4D PRIOR ART
Figure 4E:
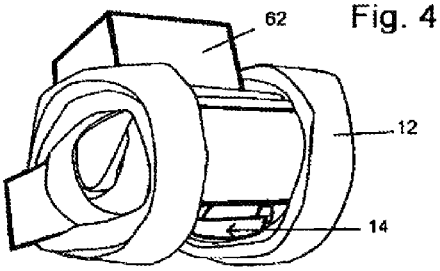
Fig. 4E PRIOR ART
FIGS. 4E and 4F are isometric, rear views of the protective cover for the head Phylactery when covering a head Phylactery.
Figure 4F:
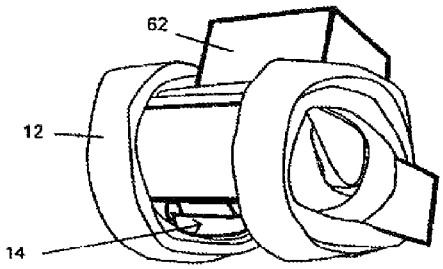
Fig. 4F PRIOR ART
Figure 5:
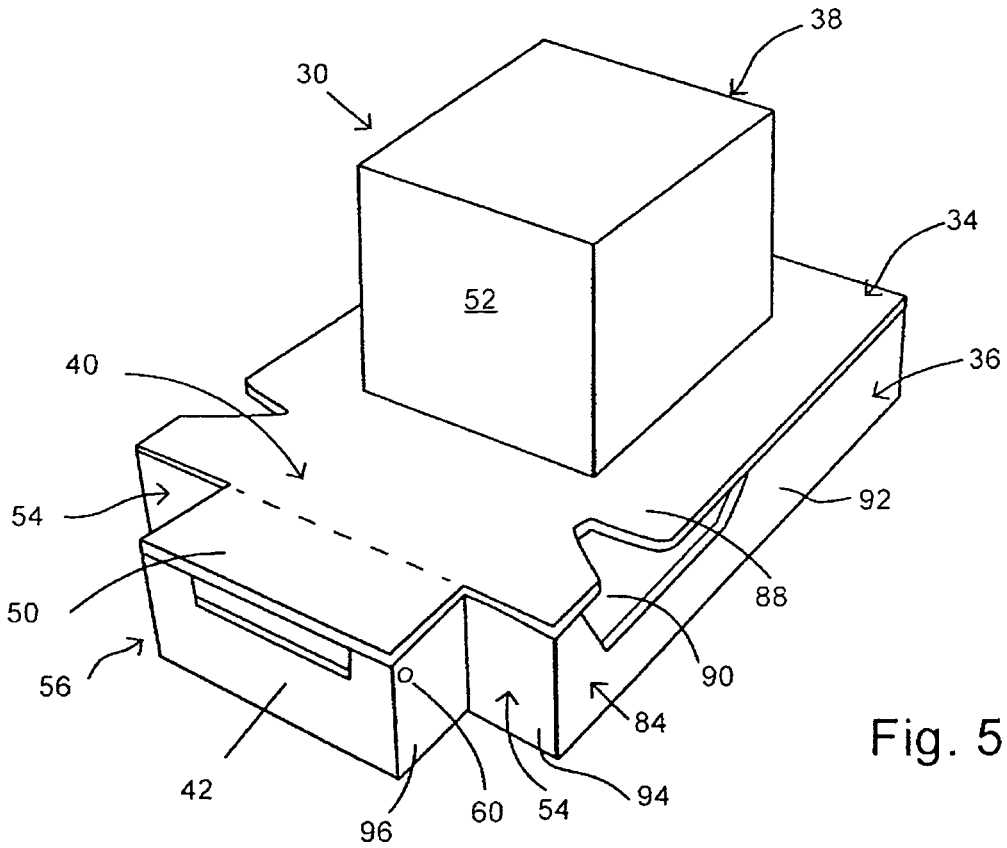
FIG. 5 is an isometric, right side view of a first embodiment of a protective cover for Phylacteries in accordance with the present invention used in particular for the head Phylactery, when in a closed state.
Figure 6:
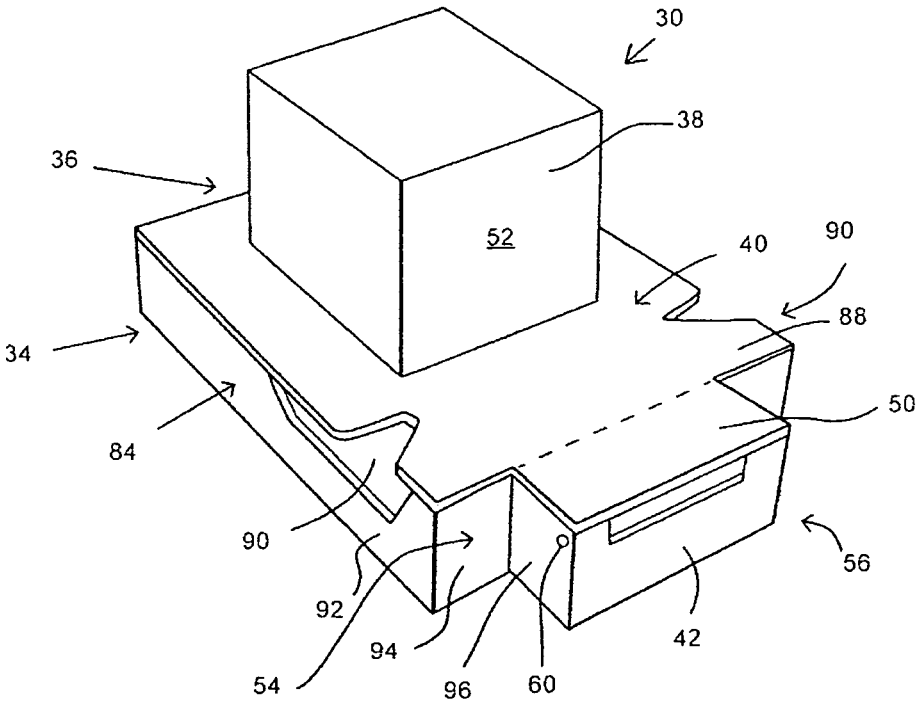
FIG. 6 is an isometric, left side view of the first embodiment of the protective cover for Phylacteries in accordance with the present invention used in particular for the head Phylactery, when in the closed state.
Figure 7:
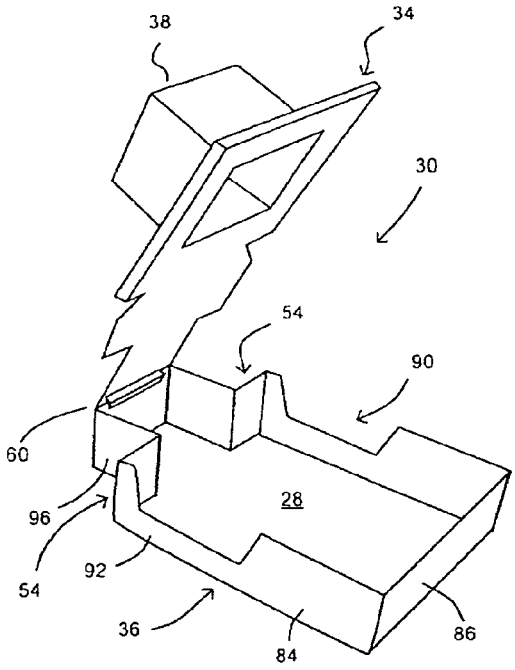
FIG. 7 is an isometric, right side view of the first embodiment of a protective cover for Phylacteries in accordance with the present invention used in particular for the head Phylactery, when in an open state.

Referring to the accompanying drawings wherein the same reference numerals refer to the same or similar elements, FIGS. 5-11 which show a protective cover intended for primary use for a head Phylactery which is designated generally as 30. Each protective cover 30 comprises an upper shell member 34 and a lower shell member 36 which in combination, define a hollow interior contoured to fit the head Phylactery. The box 10 of the head Phylactery fits inside this hollow interior and therefore the upper shell member 34 includes a generally cube-shaped portion 38, i.e., it has the same shape as the Phylactery box 10. The upper shell member 34 also includes a substantially planar lower surface 40 which surrounds the cube-shaped portion 38. This lower surface 40 is not rectangular as is the surface 80 in the conventional protective cover 62 shown in FIGS. 4A-4D, but rather has a unique shape that is designed to enable placement of the knot of the strap 14 of the head Phylactery thereon while also allowing for wrapping of the strap 12 of the head Phylactery around the protective cover 30.

The lower shell member 36 includes a lower base wall 28 (see FIGS. 7 and 8), which is opposite (faces) the lower surface 40 of the upper shell member 34, side walls 84 extending upward from the lower base wall 28, a rear wall 42 and a front wall 86. The upper and lower shell members 34, 36 are at least partially separable from one another, e.g., via the formation or placement of a hinge or pivot pin 60 connected to both (see FIGS. 5-8), to enable the placement of the protective cover 30 around the head Phylactery. The hinge or pivot pin 60 may be connected to the upper end region or upper edge of the rear wall 42 of the lower shell member 36 and the rear edge of the lower surface 40 of the upper shell member 34.

Note that for some protective covers, the side walls of the lower shell member may be formed in connection with the upper shell member so that the lower shell member is only a lower base wall pivotally connected to the lower edge region or lower edge of the rear wall of the upper shell member. Moreover, in some protective covers, the rear wall of the protective cover is split both lengthwise and heightwise so that one part is formed by the upper shell member which extends in a middle portion and the other part is formed by the lower shell member which thus has a U-shape and is situated around the part of the upper shell member forming the rear wall. The teachings of the invention described below are equally applicable to such protective covers.

An important feature of protective cover 30 for a head Phylactery in accordance with the invention is that the lower surface 40 of the upper shell member 34 includes a supplemental platform or support surface 50. Supplemental support surface 50 extends from the rear edge of a generally rectangular portion 88 of the lower surface 40 that extends around the cube-shaped 38 (see FIGS. 5 and 11—the dotted line between rectangular portion 88 and the supplemental support surface 50 is for illustration only and is not marked on the protective cover 30). Thus, the lower surface 40 of the upper shell member 34 has a non-rectangular form, because the supplemental support surface 50 extends only from part of the rear edge of the rectangular portion 88 of the lower surface 40, not the entire rear edge. The supplemental support surface 50 and the rectangular portion 88 of the lower surface 40 are contiguous to provide a surface in a common plane. The supplemental support surface 88 is situated close to the slots 90 that are defined between the side walls 84 of the lower shell member 36 and the upper shell member 34, and rearward of the rear side 52 of the cube-shaped portion 38 of the upper shell member 34 of the protective cover 30. Moreover, the supplemental support surface 50, or the part of the rear edge of the rectangular portion 88 of the lower surface 40 from which the supplemental support surface 50 extends, is in line with, i.e., aligns with and has substantially the same width as, the cube-shaped portion 38 of the upper shell member 34 (see FIG. 11). The rear side 52 of the cube-shaped portion 38 of the upper shell member 34 is that side facing the slot 90 of the protective cover 30 through which the strap 12 passes when the protective cover 30 encloses a head Phylactery. As noted above, this strap 12 includes a knot and since the supplemental support surface 50 is designed to provide a support for this knot 14, it should be arranged on the side of the cube-shaped portion where the knot 14 will be situated when the head Phylactery is enclosed by the protective cover 30.

In accordance with the invention, the supplemental support surface 50 is formed to enable the knot 14 to be seated comfortably and securely thereon. Moreover, the supplemental support surface 50 is formed in such a manner to substantially preclude the possibility of wrapping the hanging portions of the strap 12 around the knot 14 when supported on the supplemental support surface 50. To this end, the supplemental support surface 50 is formed such that it does not extend entirely across the rear side of the protective cover 30, but rather, extends substantially only alongside the cube-shaped portion 38 thereof. As such, a step or indentation 54 is formed alongside each lateral side of the protective cover 30. The length of the side portions of the protective cover 30, is not significantly affected by the presence of the supplemental support surface 50, and therefore, the hanging portions of the strap 12 can be wrapped around the side or lateral extension portions of the protective cover 30 in the same manner as for conventional protective covers. It is therefore extremely beneficial that the step 54 has a dimension that is almost equal to or slightly greater than the width of the strap to allow the strap to be wound through the step 54.

There are several ways to form the supplemental support surface 50. In a first embodiment shown in FIG. 6, the lower shell member 36 of the protective cover 30 is provided with a projection 56 at its rear side which extends outward from the rear wall 42 of the lower shell member 36, e.g., substantially only alongside the rear surface of the cube-shaped portion 38. The extent of the projection 56 may be at least about 1.0 centimeters and possibly in a range from about 1.0 centimeters to about 2.0 centimeters. The projection 56 preferably has a uniform length and/or width. In view of the formation of the projection 56, each of the side walls 84 of the lower shell member 36 has the step 54 formed therein to provide the side wall 84 with three discrete parts, a first planar part 92 that includes part of the slot 90, a second part 94 generally perpendicular to the first part 92 that is parallel to the rear wall 42, and a third part 96 that is generally parallel to the first part, with the second part being between the first and third parts 94, 96. The step 54 is formed by the intersection of the second and third parts 94, 96. The first, second and third parts 92, 94, 96, in combination, define each side wall 84 or each side surface of the protective cover 30. Moreover, the third part 96 is preferably aligned with, i.e., in line with, the side surfaces of the cube-shaped portion 38. In this manner, the strap 12, when wound about the protective cover 30, will be wound into the step 54 between the second part 94 and the third part 96, and in the preferred embodiment, against the third part 96 and simultaneously against a respective, aligning one of the side surfaces of the cube-shaped portion 38 (see FIGS. 9 and 10). This facilitates an extremely easy and secure winding of the strap about the protective cover 30. The strap 12 is therefore not wound about the supplemental support surface 50 on which the knot of the strap 12 is placed. The knot of the strap 12 is thus not covered by windings of the strap 12. Also, by virtue of the formation of the indentation or step 54 in each side wall 84, the lower base wall 28 has a first portion opposite the lower surface of the upper shell member 34 and a second portion opposite the supplemental support surface 50 whereby the second portion has a width between opposed lateral edges that is smaller than a width between opposed lateral edges of the first portion (see FIGS. 7 and 8).

Figure 8:
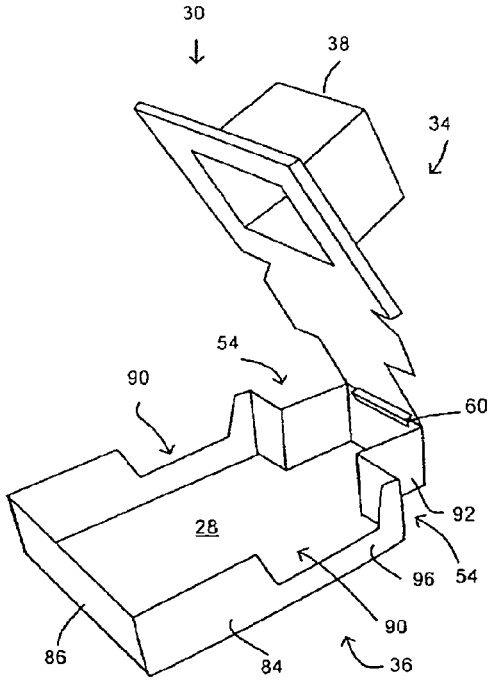
FIG. 8 is an isometric, left side view of the first embodiment of the protective cover for Phylacteries in accordance with the present invention used in particular for the head Phylactery, when in the open closed state.
Figure 9:
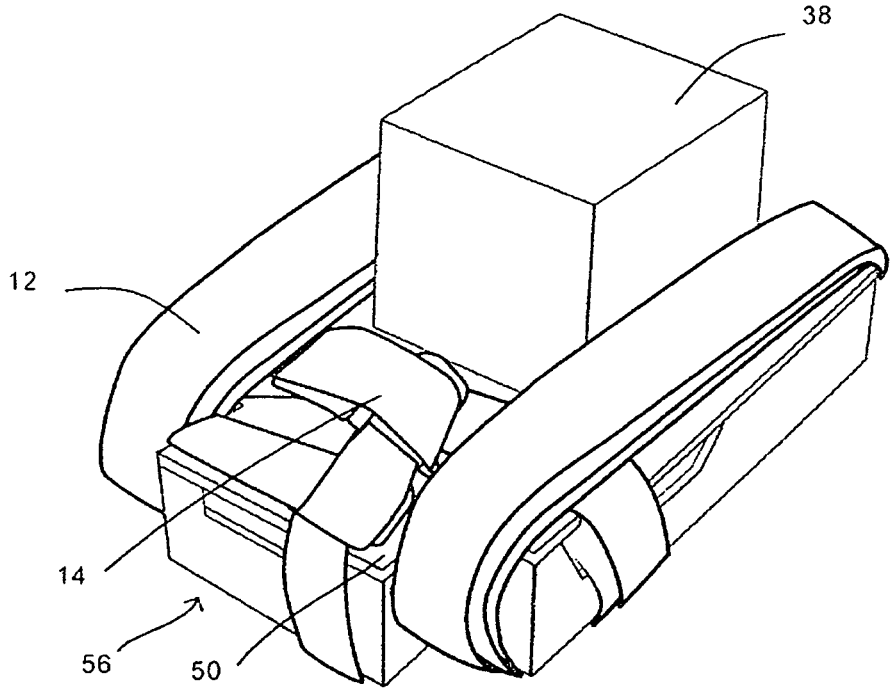
FIG. 9 is an isometric, right side view of the protective cover shown in FIGS. 5-8 with the strap wrapped around the sides of the protective cover and showing the general placement of the knot.
Figure 10:
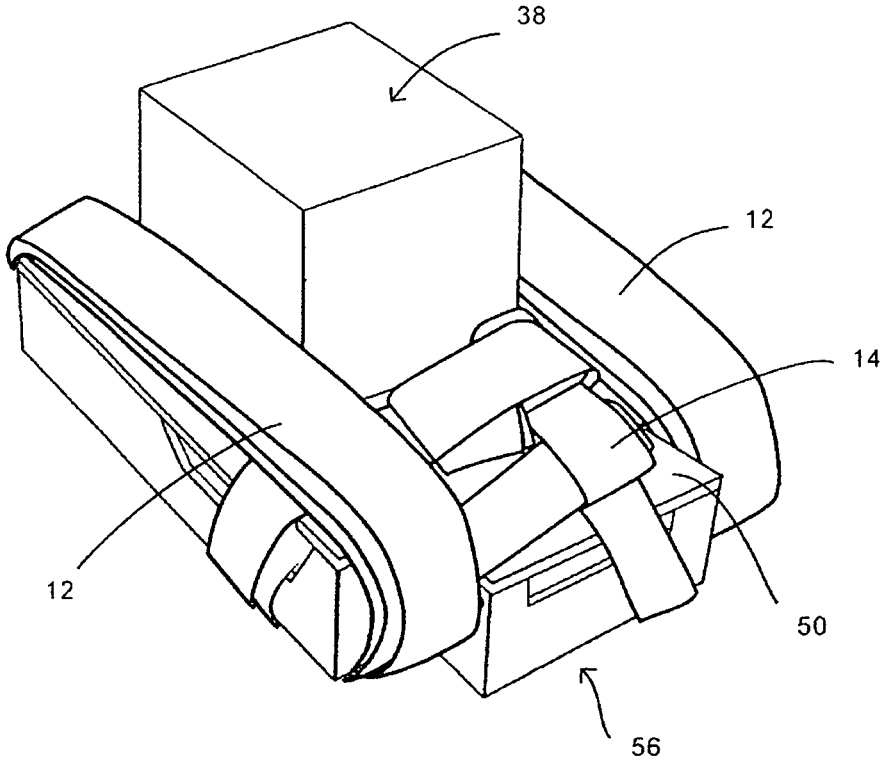
FIG. 10 is an isometric, left side view of the protective cover shown in FIGS. 5-8 with the strap wrapped around the sides of the protective cover and showing the general placement of the knot.
Figure 11:
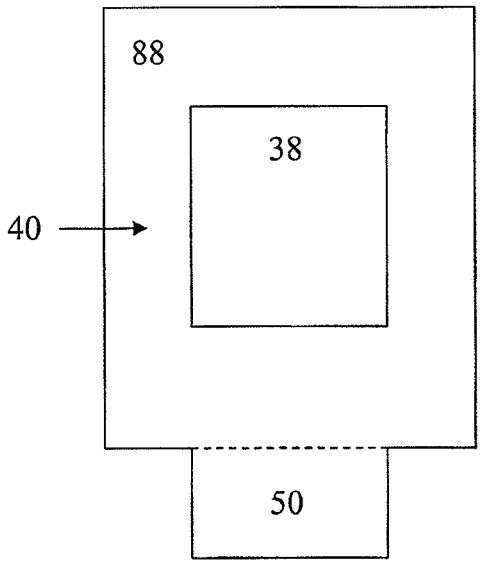
FIG. 11 is a top view of the protective cover shown in FIGS. 5-8.

In another embodiment shown in FIG. 8 of the '298 application, the supplemental support surface is in the form of a thin ledge extending outward from the upper edge region of the rear wall of the lower shell member of the protective cover. The ledge has a projecting length of at least about 1.0 centimeters, and possibly in a range from about 1.0 centimeters to about 2.0 centimeters, outward from the rear wall of the lower shell member to thereby form the knot-supporting supplemental support surface.

The ledge may be an extension of the lower surface of the upper shell member. The lower surface and the ledge may therefore be formed as a unitary or single piece of plastic or other material, e.g., hard or rigid plastic material. Also, for easy handling of the protective cover when closed, it may be preferable that the ledge does not extend from the lower surface more than the height of the rear wall of the lower shell member. When in the use position, the ledge will be able to support the knot of the strap of a head Phylactery.

To account for alternative constructions of a protective cover wherein the pin or hinge connecting the upper and lower shell members, is arranged at locations other than the upper end region of the rear wall of the lower shell member, or the upper and lower shell members are entirely separable from one another, the ledge may be formed to extend from the lower edge region or lower edge of the rear surface of the cube-shaped portion of the upper shell member. In this case, the ledge may be dimensioned such that it extends at least about 1.0 centimeters beyond the rear wall, and possibly in a range from about 1.0 centimeters to about 2.0 centimeters. Alternatively, the ledge may be formed to extend from the rear wall of the lower shell member. In these embodiments, the ledge should be constructed and/or arranged to provide a stable platform for supporting the knot of the strap of a head Phylactery.

The ledge may have a rectangular shape or any other desired shape which provides a sufficiently large upper surface area to enable support of the knot of a strap of a head Phylactery. Since there are different sizes of straps and thus different sizes of knots, different size ledges may be provided for protective covers having the same cube-shaped portion 8.

Moreover, different sets of protective covers 30 may be provided, with the protective covers in each set having the same size cube-shaped portion 38 of the upper shell member 34 but a different size supplemental support surface 50, whether formed by the projection 56 or ledge. Then, depending on the size of the knot 14 of the strap 12 provided in the head Phylactery for which a protective cover 30 is sought, the individual could select one of the different protective covers 30 having a supplemental support surface 50 which can suitably support the knot 14.

For any of the embodiments above, it should be appreciated that any of the lateral extension portions, projection 56 and ledge can be replaced with a separate extender to be configured with a conventional protective cover so that that conventional protective cover accommodates the wrapping and placement of straps, as set forth herein.

Another way to consider the invention is that it provides protective covers for Phylacteries having an asymmetrical shape. Currently, protective covers for Phylacteries are generally symmetrical, i.e., having the same extension depth from the cube-shaped portion on opposite sides thereof, but protective covers in accordance with the invention deviate from this symmetry by providing the projection 56. The projection 56 causes the protective cover 30 to assume an asymmetrical shape because the shape of the side of the protective cover 30 on which the projection is located is now significantly different than the shape of the opposite side of the protective cover 30.

The '298 application, incorporated by reference herein, discloses additional protective covers for Phylacteries. In one of the embodiments disclosed therein, the protective cover is provided with a pair of lateral extension portions on opposite sides of the cube-shaped portion which increases the available surface areas on the lateral sides of the protective cover (see FIG. 5 thereof). These lateral extension portions will be those portions of the protective cover around which the hanging portions of the strap of the head Phylactery are wound when storing the head Phylactery. To achieve this, the lateral extension portions preferably have a width (designated W in FIG. 5 thereof) of at least about 1.2 centimeters, and may be in a range of from about 1.2 centimeters to about 2.0 centimeters. This width is meaningfully greater than the width of the corresponding side portions of conventional protective covers for head Phylacteries and serves a particular purpose, namely to provide a sufficiently wide platform around which to wrap the hanging portions of the strap, which themselves are usually between 0.9 and 1.5 centimeters wide.

To form the lateral extension portions, side portions of the lower surface of the upper shell member and side portions of the front wall, rear wall, and lower base wall of the lower shell member are all dimensioned to extend laterally outward from planes including the side surfaces of the cube-shaped portion of the upper shell member a distance or width w of at least about 1.2 centimeters. Since the hanging portions of the strap 12 of the head Phylactery have a width substantially equal to or slightly less than the minimum width of the lateral extension portions, they can be easily wound around the lateral extension portions.

In a variation of this embodiment, it is possible to provide for a plurality of different protective covers for head Phylacteries. Different sets of protective covers would be provided, with the protective covers in each set having the same size cube-shaped portion but different size lateral extension portions. Then, depending on the width of the strap provided in the head Phylactery for which a protective cover is sought, the individual could select one of the different protective covers having lateral extension portions having a width equal to or greater than the width of the strap. So long as the width of the lateral extension portions is almost equal to or greater than the width of the strap, the hanging portions of strap could be securely wrapped around the lateral extension portions.

Moreover, by providing the lateral extension portions with a width of greater than about 1.2 centimeters, and thus greater than or substantially equal to the width of the strap of a head Phylactery, it is possible to position the knot of the strap onto the lower surface of the upper shell member between planes (i.e., entirely alongside the rear surface of the cube-shaped portion of the upper shell member) and then wrap the hanging portions of the strap around the lateral extension portions. In this manner, the strap is not wrapped over the knot, thereby complying with the scholarly opinion above that the strap cannot be wrapped over the knot.

In a similar manner as a protective cover for head Phylacteries is provided with an increased surface area along side portions thereof to enable a strap to be wrapped thereon, a protective cover for the arm Phylactery may similarly include an increased surface area. However, for the arm Phylactery, the lower shell member includes only one lateral extension portion (see FIG. 9 of the '298 application), and not two lateral extension portions on opposite sides of the cube-shaped portion of the upper shell member as for the head Phylactery described above. This is because the strap of the arm Phylactery is generally wound on only one side of the protective cover to avoid wrapping it over the knot which is on the other side of the protective cover. The singular lateral extension portion would be formed on that side of the protective cover opposite the side on which the knot is situated, which varies, for example, depending on whether the person is right-handed or left-handed.

For the protective covers for the arm Phylacteries, the lateral extension portion may be provided with a width (extension distance from the plane including the side surface of the cube-shaped portion of the upper shell member opposite that side surface alongside which the knot is situated) of greater than about 1.2 centimeters, and possibly in a range of from about 1.2 centimeters to about 2.0 centimeters. As such, when the strap of the arm Phylactery, having a width of between 0.9 and 1.5 centimeters, is wrapped around the lateral extension portion, it will not fall off the edge of the protective cover.

In one embodiment of the invention, it is possible to provide for a plurality of different protective covers for arm Phylacteries. Different sets of protective covers would be provided, with the protective covers in each set having the same size cube-shaped portion of the upper shell member but a different size lateral extension portion. Then, depending on the width of the strap provided in the arm Phylactery for which a protective cover is sought, the individual could select one of the different protective covers having a lateral extension portion having a width equal to or greater than the width of the strap. So long as the width of the lateral extension portion is almost equal to or greater than the width of the strap, the strap could be securely wrapped around the lateral extension portion.

Moreover, by providing the lateral extension portion with a width of greater than about 1.2 centimeters, and thus greater than or substantially equal to the width of the strap of an arm Phylactery, it is possible to avoid wrapping the strap over the knot, thereby complying with the scholarly opinion above that the strap cannot be wrapped over the knot.

While the foregoing description and drawings represent the preferred embodiments of the present invention, it will be understood that various changes and modifications may be made without departing from the scope of the present invention.

What is claimed is:

1. A protective cover for a Phylactery, comprising:

an upper shell member and a lower shell member at least partially separable from one another and which, when together, define a hollow interior contoured to fit the Phylactery and a slot through which a strap of the Phylactery passes when the Phylactery is housed in the protective cover, said upper shell member including a generally cube-shaped portion and a substantially planar lower surface around said cube-shaped portion, the protective cover having a front wall in front of said slot; and the improvement comprising:

the protective cover including at least one wall part parallel to said front wall, each of said at least one wall part being rearward of said slot such that said slot is situated forward of said at least one wall part, said lower surface of said upper shell member overlying said slot, and a supplemental support surface extending rearward from only part of a rear edge of said lower surface of said upper shell member and being situated rearward of said at least one wall part, said rear edge of said lower surface of said upper shell member from which said supplemental support surface extends being rearward of said slot, said part of said rear edge of said lower surface of said upper shell member from which said supplemental support surface extends being in line with said cube-shaped portion of said upper shell member, said supplemental support surface in combination with said lower surface of said upper shell member providing support for the strap and a knot of the strap of the Phylactery when the Phylactery is housed in the protective cover.

2. The protective cover of claim 1, wherein said supplemental support surface is formed to enable the knot to be seated comfortably and securely thereon and to substantially preclude the possibility of wrapping hanging portions of the strap around the knot when supported on said supplemental support surface.

3. The protective cover of claim 1, wherein said at least one wall part comprises two wall parts on opposite sides of said supplemental support surface.

4. The protective cover of claim 1, wherein the protective cover has a pair of side surfaces each including a first part substantially parallel to a side surface of said cube-shaped portion of said upper shell member, a second part perpendicular to said first part and a third part parallel to said first part and perpendicular to said second part, said second part of each of said side surfaces constituting said at least one wall part that is parallel to said front wall of the protective cover, said second part on each lateral side of the protective cover being situated between said first and third parts.

5. The protective cover of claim 4, wherein said second part has a size to enable the strap of the Phylactery to be wound against said second part and around a side portion of the protective cover that is situated to a respective side of said cube-shaped portion of said upper shell member.

6. The protective cover of claim 4, wherein said third part on each of said side surfaces aligns with a respective side surface of said cube-shaped portion of said upper shell member such that the strap of the Phylactery is windable to be simultaneously against said third part and said side surface of said cube-shaped portion.

7. The protective cover of claim 1, further comprising a rearwardly extending projection situated on a rear side of said lower shell member along only part of said rear side of said lower shell member.

8. The protective cover of claim 7, wherein said part of said rear side of said lower shell member along which said projection is situated coincides with said part of said rear edge of said lower surface of said upper shell member from which said supplemental support surface extends such that said projection defines said supplemental support surface.

9. The protective cover of claim 7, wherein said projection extends only alongside said cube-shaped portion.

10. The protective cover of claim 7, further comprising a connection mechanism arranged partly on said projection for pivotally or hingedly connecting said upper and lower shell members.

11. The protective cover of claim 1, further comprising a connection mechanism arranged underneath said supplemental support surface to enable said upper and lower shell members to pivot relative to one another.

12. The protective cover of claim 1, wherein said supplemental support surface has a width of at least about 1.0 centimeters beyond a rear wall of said lower shell member and may be in a range from about 1.0 centimeters to about 2.0 centimeters.

13. The protective cover of claim 1, wherein said supplemental support surface is contiguous with said lower surface of said upper shell member.

14. A protective cover for a Phylactery including a slot through which a strap of the Phylactery passes when the Phylactery is housed in the protective cover, comprising:

an upper shell member and a lower shell member at least partially separable from one another and which, when together, define a hollow interior contoured to fit the Phylactery, said upper shell member including a generally cube-shaped portion and a substantially planar lower surface around said cube-shaped portion; and the improvement comprising:

a supplemental support surface extending rearward from only part of a rear edge of said lower surface of said upper shell member, said part of said rear edge of said lower surface of said upper shell member from which said supplemental support surface extends being in line with said cube-shaped portion of said upper shell member, said supplemental support surface not extending entirely across a rear side of the protective cover to thereby form an indentation alongside each lateral side of the protective cover, the protective cover having a pair of side surfaces each including a first part substantially parallel to a side surface of said cube-shaped portion of said upper shell member, a second part perpendicular to said first part and a third part parallel to said first part and perpendicular to said second part, said indentation on each lateral side of said protective cover being formed by said second and third parts.

15. The protective cover of claim 14, wherein said second part has a size to enable the strap of the Phylactery to be wound against said second part and around a side portion of the protective cover that is situated to a respective side of said cube-shaped portion of said upper shell member.

16. The protective cover of claim 14, wherein said third part on each of said side surfaces aligns with a respective side surface of said cube-shaped portion of said upper shell member such that the strap of the Phylactery is windable to be simultaneously against said third part and said side surface of said cube-shaped portion.

17. The protective cover of claim 14, wherein said lower surface of said upper shell member overlies said slot and said rear edge of said lower surface of said upper shell member is rearward of said slot.

18. A protective cover for a Phylactery including a slot through which a strap of the Phylactery passes when the Phylactery is housed in the protective cover, comprising:

an upper shell member and a lower shell member at least partially separable from one another and which, when together, define a hollow interior contoured to fit the Phylactery, said upper shell member including a generally cube-shaped portion and a substantially planar lower surface around said cube-shaped portion, said lower shell member including a front wall, a rear wall opposite said front wall and two side walls; and the improvement comprising:

a supplemental support surface extending rearward from only part of a rear edge of said lower surface of said upper shell member, said part of said rear edge of said lower surface of said upper shell member from which said supplemental support surface extends being in line with said cube-shaped portion of said upper shell member, and a rearwardly extending projection situated on a rear side of said lower shell member along only part of said rear side of said lower shell member, said projection projecting on said rear wall.

19. The protective cover of claim 18, wherein said lower surface of said upper shell member overlies said slot and said rear edge of said lower surface of said upper shell member is rearward of said slot.

20. The protective cover of claim 18, wherein said projection includes a first portion parallel to said rear wall, and two second portions each extending between an outer edge of said first portion and an inner edge of said rear wall.

21. A protective cover for a Phylactery, comprising:

an upper shell member and a lower shell member at least partially separable from one another and which, when together, define a hollow interior contoured to fit the Phylactery and a slot through which a strap of the Phylactery passes when the Phylactery is housed in the protective cover, said upper shell member including a generally cube-shaped portion and a substantially planar lower surface around said cube-shaped portion, the protective cover having a front wall in front of said slot; and the improvement comprising:

a supplemental support surface extending rearward from only part of a rear edge of said lower surface of said upper shell member, said rear edge of said lower surface of said upper shell member from which said supplemental support surface extends being rearward of said slot, said lower surface of said upper shell member overlying said slot, said lower shell member including a lower base wall having a first portion opposite said lower surface of said upper shell member and a second portion opposite said supplemental support surface, said second portion having a width between opposed lateral edges that is smaller than a width between opposed lateral edges of said first portion, the protective cover including a projection defining a rear wall rearward of said slot such that said slot is situated forward of said rear wall, said projection being situated at least partly below said supplemental support surface, said rear wall being situated at a rear of said second portion of said lower base wall, and the protective cover further including a hinge arranged partly on said projection to provide for pivotal movement of said upper and lower shell members relative to one another.

* * * * *